US006890707B2

(12) United States Patent
Weimann et al.

(10) Patent No.: US 6,890,707 B2
(45) Date of Patent: May 10, 2005

(54) COLOR PHOTOGRAPHIC PRINT MATERIAL

(75) Inventors: Ralf Weimann, Leverkusen (DE); Markus Geiger, Cologne (DE); Cuong Ly, Cologne (DE); Klaus Sinzger, Leverkusen (DE); Beate Weber, Leichlingen (DE); Heinz Wiesen, Kieselweg (DE)

(73) Assignee: Agfa-Gevaert (BE)

( * ) Notice: Subject to any disclaimer, the term of this patent is extended or adjusted under 35 U.S.C. 154(b) by 108 days.

(21) Appl. No.: 10/612,809

(22) Filed: Jul. 2, 2003

(65) Prior Publication Data

US 2004/0023173 A1 Feb. 5, 2004

(30) Foreign Application Priority Data

Jul. 10, 2002 (DE) ..... 102 30 981

(51) Int. Cl.[7] ..... G03C 1/08; G03C 7/25; G03C 7/32

(52) U.S. Cl. ..... 430/553; 430/552; 430/604; 430/605; 430/599; 430/494

(58) Field of Search ..... 430/552, 553, 430/567, 599, 604, 605, 494

(56) References Cited

U.S. PATENT DOCUMENTS

| | | | | |
|---|---|---|---|---|
| 5,814,439 | A * | 9/1998 | Ohshima et al. | 430/604 |
| 5,922,526 | A | 7/1999 | Missfeldt | 430/584 |
| 6,534,254 | B1 * | 3/2003 | Helling et al. | 430/552 |
| 6,558,887 | B2 * | 5/2003 | Helling et al. | 430/552 |
| 2002/0051945 | A1 | 5/2002 | Begley et al. | |
| 2003/0064331 | A1 | 4/2003 | Ly et al. | 430/552 |

FOREIGN PATENT DOCUMENTS

| | | |
|---|---|---|
| DE | 196 46 855 | 5/1998 |
| DE | 100 55 094 | 5/2002 |
| EP | 0 571 959 | 12/1993 |
| EP | 1 113 327 | 7/2001 |
| EP | 1 113 329 | 7/2002 |
| GB | 2 316 495 | 2/1998 |

* cited by examiner

*Primary Examiner*—Geraldine Letscher
(74) *Attorney, Agent, or Firm*—Connolly Bove Lodge & Hutz LLP

(57) ABSTRACT

A print material having a support, at least one red-sensitive silver halide emulsion layer containing at least one cyan coupler, at least one green-sensitive silver halide emulsion layer containing at least one magenta coupler and at least one blue-sensitive silver halide emulsion layer containing at least one yellow coupler, characterised in that the silver halide crystals of the red-sensitive layer have a chloride content of at least 95 mol %, contain 20 to 500 nmol of iridium per mol of silver halide and the cyan coupler is of the formula (I)

in which $R^1$ means a hydrogen atom or an alkyl group, $R^2$ means an alkyl, aryl or hetaryl group, $R^3$ means an alkyl or aryl group, $R^4$ means an alkyl, alkenyl, alkoxy, aryloxy, acyloxy, acylamino, sulfonyloxy, sulfamoylamino, sulfonamido, ureido, hydroxycarbonyl, hydroxycarbonylamino, carbamoyl, alkylthio, arylthio, alkylamino or arylamino group or a hydrogen atom and Z means a hydrogen atom or a group eliminable under the conditions of chromogenic development, is distinguished in that it is equally ideally suitable for analogue and scanning exposure and exhibits very good latent image stability.

6 Claims, No Drawings

COLOR PHOTOGRAPHIC PRINT MATERIAL

This invention relates to a colour photographic print material having a novel cyan coupler and a silver halide emulsion with an elevated chloride content.

Colour photographic print materials are in particular materials for reflection prints or displays, which most usually exhibit a positive image. They are thus not a recording material like colour photographic films.

Colour photographic print materials conventionally contain at least one red-sensitive silver halide emulsion layer containing at least one cyan coupler, at least one green-sensitive silver halide emulsion layer containing at least one magenta coupler and at least one blue-sensitive silver halide emulsion layer containing at least one yellow coupler.

Colour photographic print materials, such as colour photographic paper, are not only exposed, as has long been known, with analogue printers, but also increasingly with digital, scanning printers.

One substantial difference between these printers, which are also known as film recorders, is exposure time.

In analogue units, the original is exposed as a whole and even in high performance printers of this type, the exposure time is greater than 1 millisecond. Down to this exposure time, reciprocity failure (Schwarzschild effect) of the conventionally used silver halide emulsions is not usually a critical factor.

In contrast, in scanning exposure, which is often also known as digital exposure, the original is first digitised and then exposed pixel-by-pixel, line-by-line onto the print material with high-intensity collimated light, e.g. with a laser, a cathode ray tube or with light-emitting diodes. Consequently, each pixel is exposed for only a very short time, frequently shorter than one microsecond. A pixel should be taken to mean the smallest image area on the print material which can be resolved by the particular exposure unit.

Especially at high densities, this results in the problem of line blurring. In the image, this is manifested by fuzzy reproduction of edges, for example of letters, in the subject and is graphically described, for example, as "blooming", "bleeding", "fringe formation", "smudging" or "fuzziness". This limits the usable density range of the photographic paper. Photographic materials for exposure with scanning film recorders may accordingly exhibit only slight line blurring at elevated colour density.

Particularly stringent requirements apply to a print material which is to be suitable for both analogue and scanning printers. To this end, it is necessary for the material not to exhibit the Schwarzschild effect, in particular gradation high-intensity reciprocity failure, even at very short pixel exposure times because it would otherwise be impossible to adjust the gradation of the print material to the original material, such adjustment giving rise to satisfactory results for both analogue and scanning exposure.

It is known from EP 774 689 that, in order to achieve a higher colour density from pixel-by-pixel exposure using high-intensity collimated light and very short exposure times per pixel, the gradation of the photosensitive layers of the colour negative paper used should be steep.

One common method for steepening the gradation of the photosensitive layers in colour negative papers is to increase the silver halide or colour coupler content thereof, but this results in increased material costs and impaired processing stability, in particular at colour development times of less than 45 seconds. Moreover, due to its high contrast, such a material is not suitable for producing prints from colour negative films with analogue film recorders. Processing stability is taken to mean the fluctuation in sensitometry occurring as a function of the process and of the variation in processing within a facility.

It is known from EP 350 046 and U.S. Pat. No. 5,500,329 that gradation in the second or millisecond exposure range, which corresponds to the exposure times of analogue film recorders, may be increased by doping the silver halides with metal ions of metals of group VIII of the periodic system of elements, in particular with iridium.

It is known from the paper by Masonobu Miyoshi, Konica Corporation Japan from the IS&T's Eleventh International Symposium on Photofinishing Technologies from 30.01.2000 to 01.02.2000, Las Vegas, Nev. USA, page 60 of the proceeding books that doping silver halide crystals with transition metal complexes, for example with iridium complexes, is an effective countermeasure to reduce gradation and sensitivity high-intensity reciprocity failure (HIRF).

However, doping with iridium results in unsatisfactory latent image stability.

No print materials are known which are equally suitable for analogue and scanning exposure and which exhibit satisfactory latent image stability.

The object of the invention was to overcome the above-stated disadvantage. This is surprisingly achieved with the cyan coupler defined below and iridium-doped silver halide emulsions with an elevated chloride content.

The present invention accordingly provides a print material having a support, at least one red-sensitive silver halide emulsion layer containing at least one cyan coupler, at least one green-sensitive silver halide emulsion layer containing at least one magenta coupler and at least one blue-sensitive silver halide emulsion layer containing at least one yellow coupler, characterised in that the silver halide crystals of the red-sensitive layer have a chloride content of at least 95 mol %, contain 20 to 500 nmol of iridium per mol of silver halide and the cyan coupler is of the formula (I)

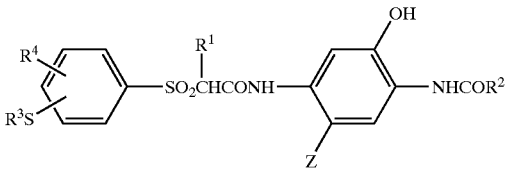

in which $R^1$ means a hydrogen atom or an alkyl group, $R^2$ means an alkyl, aryl or hetaryl group, $R^3$ means an alkyl or aryl group, $R^4$ means an alkyl, alkenyl, alkoxy, aryloxy, acyloxy, acylamino, sulfonyloxy, sulfamoylamino, sulfonamido, ureido, hydroxycarbonyl, hydroxycarbonylamino, carbamoyl, alkylthio, arylthio, alkylamino or arylamino group or a hydrogen atom and Z means a hydrogen atom or a group eliminable under the conditions of chromogenic development.

The following meanings preferably apply:

$R^1$=an alkyl group;

R2=unsubstituted or substituted phenyl, thienyl or thiazolyl group;

$R^3$=alkyl group;

$R^4$=hydrogen atom;

Z=Cl;

The cyan coupler is particularly preferably of the formula (I-A)

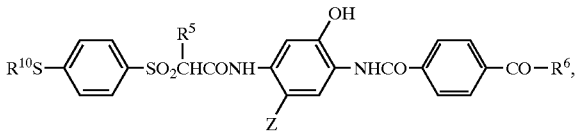

in which $R^5$ means a hydrogen atom or an alkyl group, $R^6$ means $OR^7$ or $NR^8R^9$, $R^7$ means an unsubstituted or substituted alkyl group with 1 to 6 C atoms, $R^8$ means an unsubstituted or substituted alkyl group with 1 to 6 C atoms, $R^9$ means a hydrogen atom or an unsubstituted or substituted alkyl group with 1 to 6 C atoms, $R^{10}$ means an unsubstituted or substituted alkyl group and Z means a hydrogen atom or a group eliminable under the conditions of chromogenic development and wherein the total number of the C atoms of the alkyl groups $R^7$ to $R^{10}$ in a coupler molecule is 8 to 18.

The alkyl groups can be straight chain, branched or cyclic and the alkyl, aryl and hetaryl groups can be substituted, for example, by alkyl, alkenyl, alkyne, alkylene, aryl, heterocyclyl, hydroxy, carboxy, halogen, alkoxy, aryloxy, heterocyclyloxy, alkylthio, arylthio, heterocyclylthio, alkylseleno, arylseleno, heterocyclylseleno, acyl, acyloxy, acylamino, cyano, nitro, amino, thio or mercapto groups, wherein a heterocyclyl represents a saturated, unsaturated or aromatic heterocyclic radical and an acyl represents the radical of an aliphatic, olefinic or aromatic carboxylic, carbamic, carbonic, sulphonic, amidosulphonic, phosphoric, phosphonic, phosphorous, phosphinic or sulphinic acid.

Preferably the alkyl groups can be substituted, for example, by alkyl, alkylene, hydroxy, alkoxy or acyloxy groups and most preferably by hydroxy or alkoxy groups. Preferred substituents for aryl and hetarylgroups are halogen, in particular Cl and F, alkyl, fluorinated alkyl, cyano, acyl, acylamino or carboxy groups.

Suitable cyan couplers are:

I-1

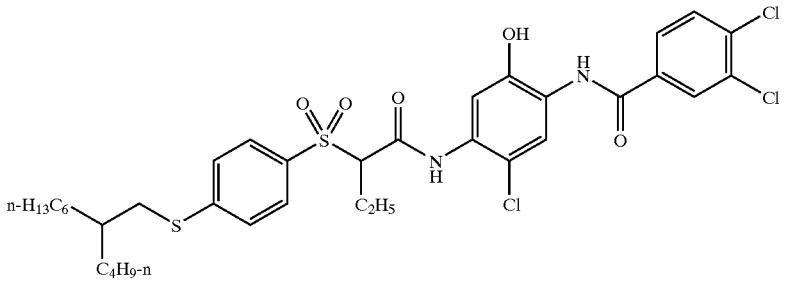

I-2

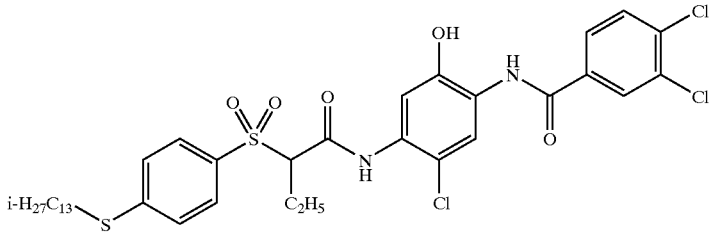

I-3

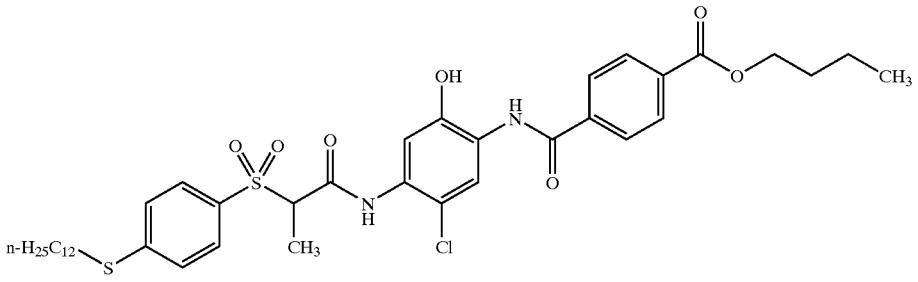

-continued
Suitable cyan couplers are:
I-4
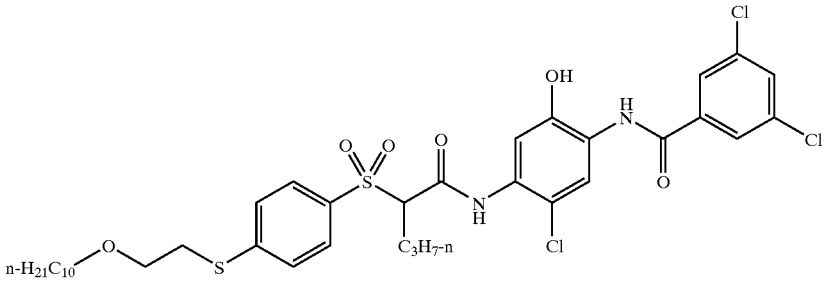
I-5
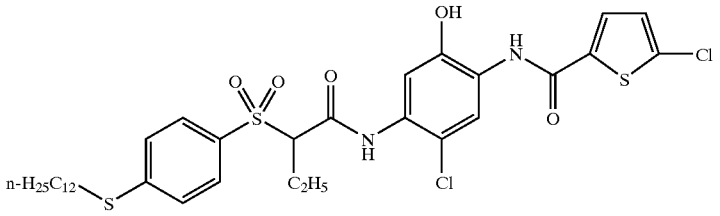
I-6
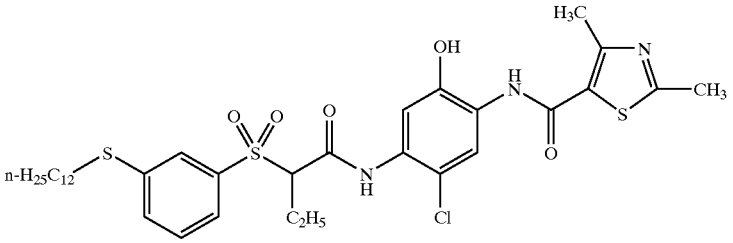
I-7
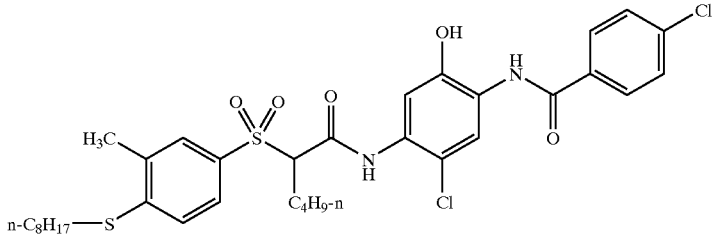
I-8
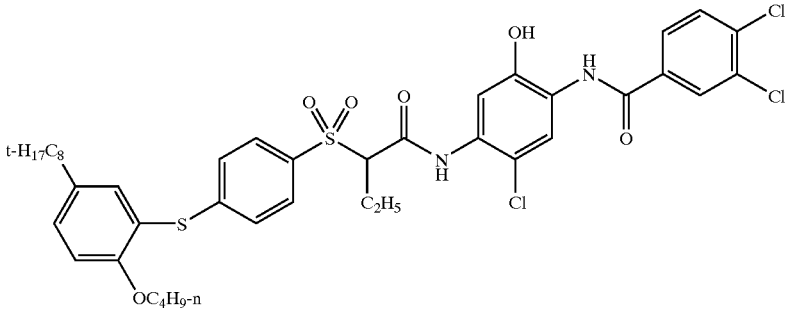

-continued
Suitable cyan couplers are:
I-9
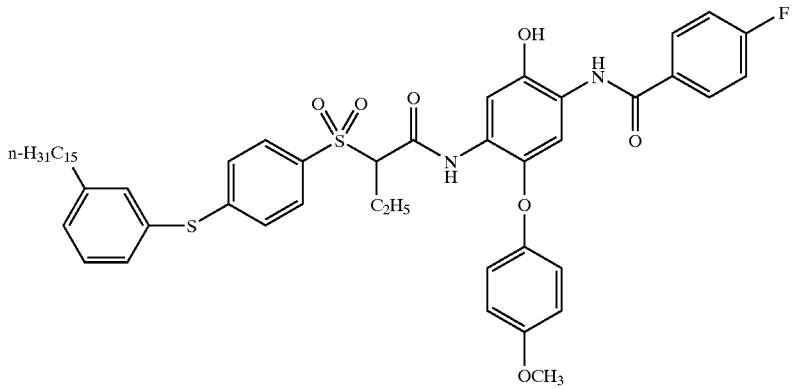
I-10
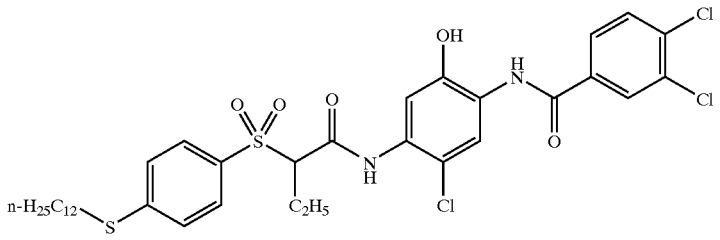
I-11
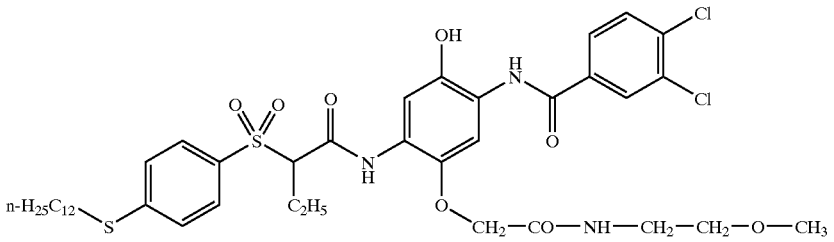
I-12
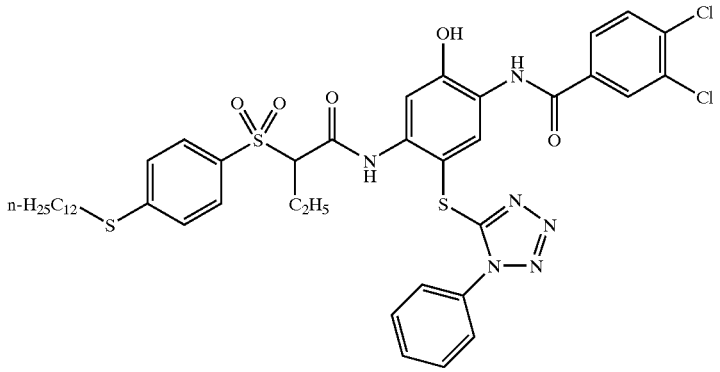
I-13
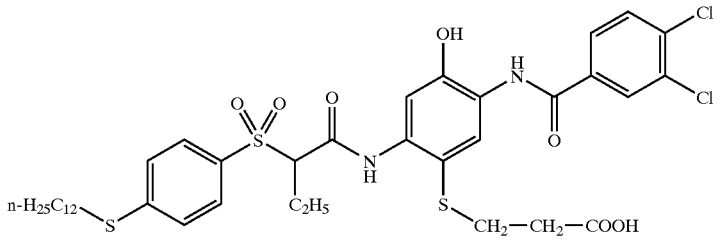

-continued
Suitable cyan couplers are:
I-14
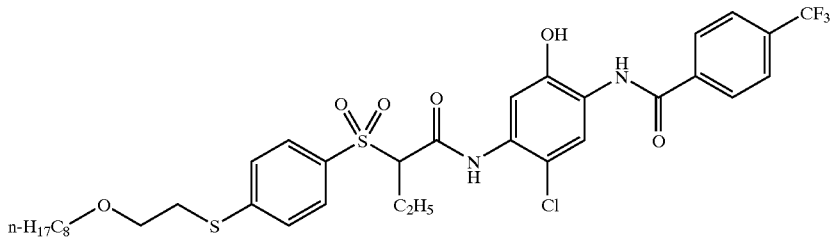
I-15
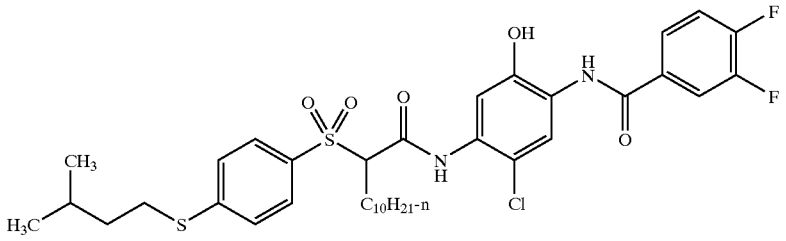
I-16
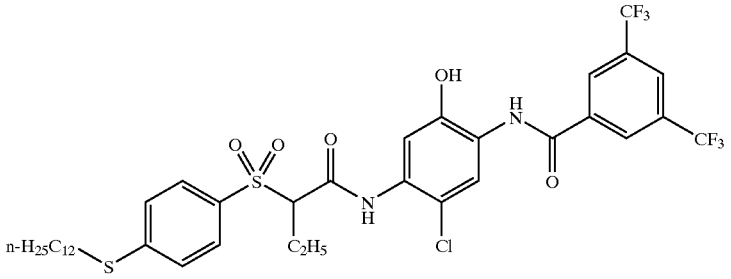
I-17
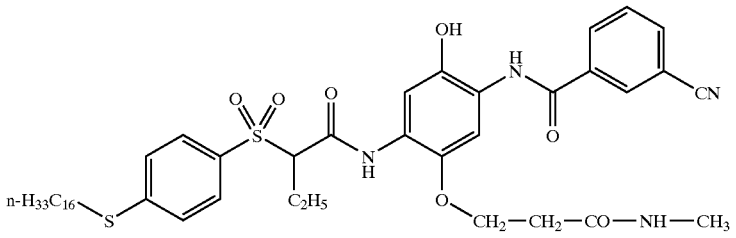
I-18
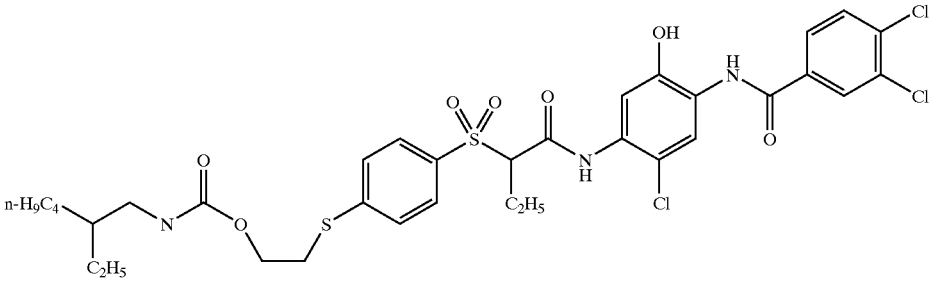

-continued
Suitable cyan couplers are:
I-19
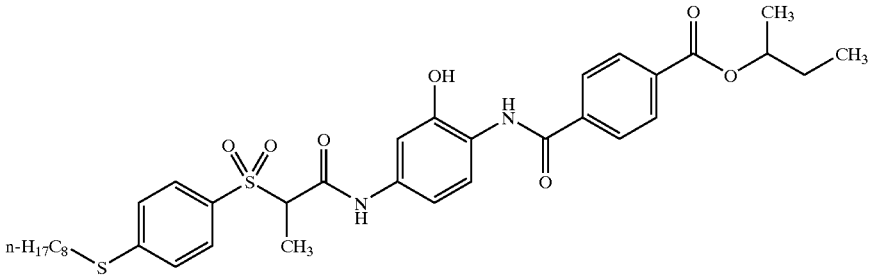
I-20
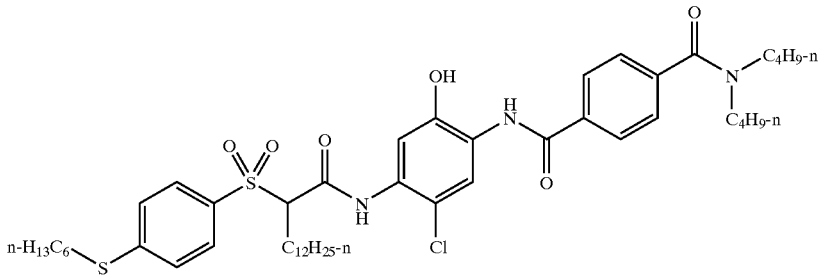
I-21
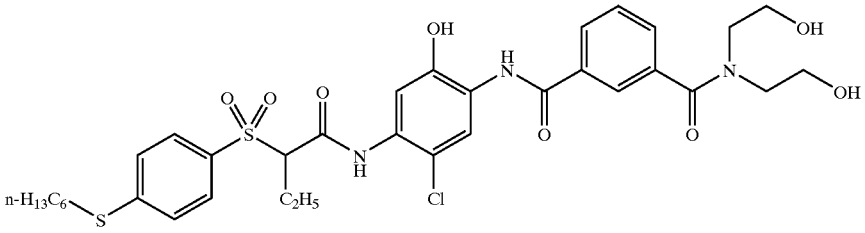
I-22
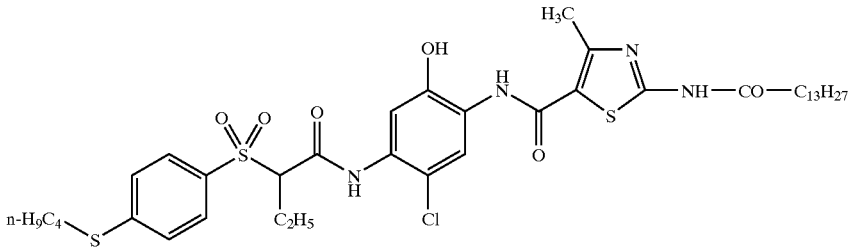
I-23
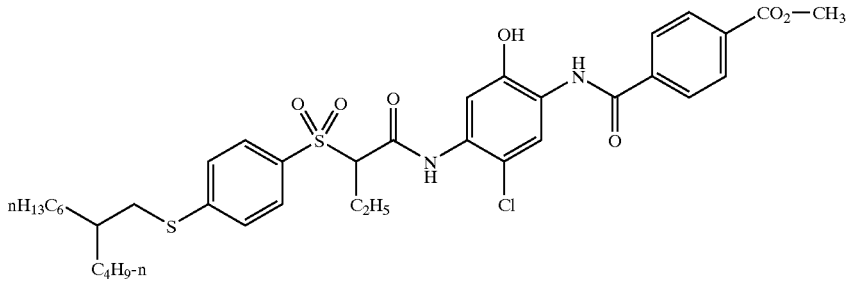

-continued
| Suitable cyan couplers are: |
|---|
| I-24 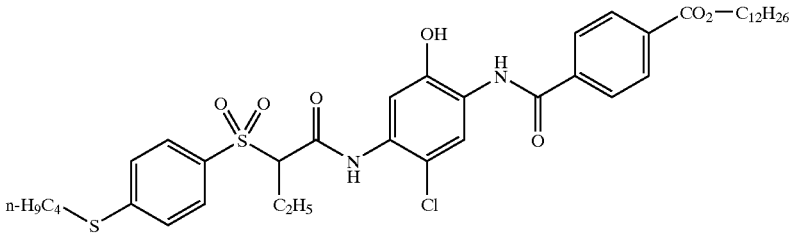 |
| I-25 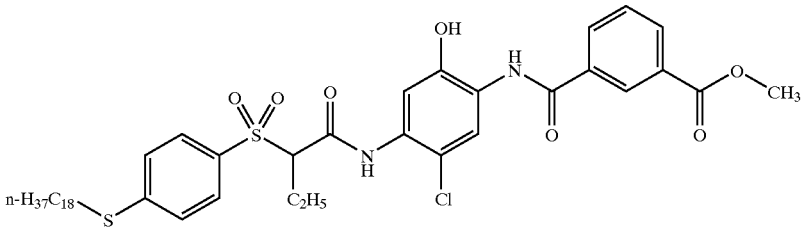 |
| I-26 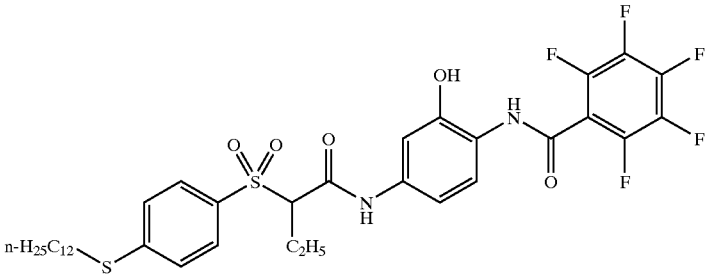 |
| I-27 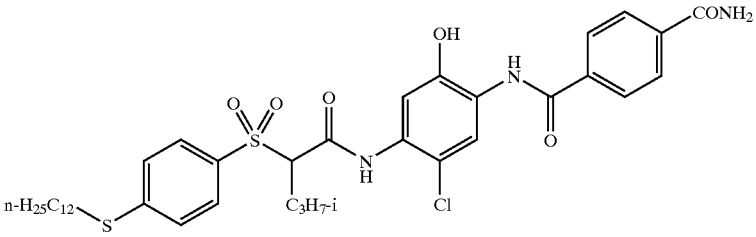 |
| I-28 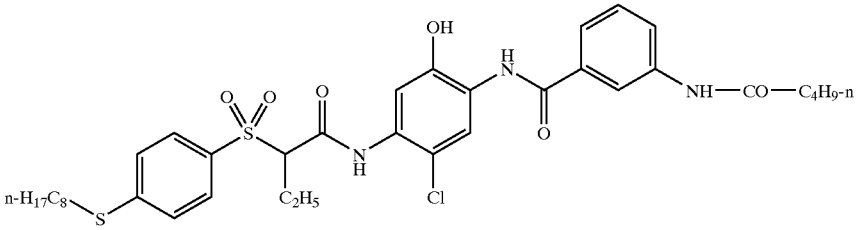 |
| I-29 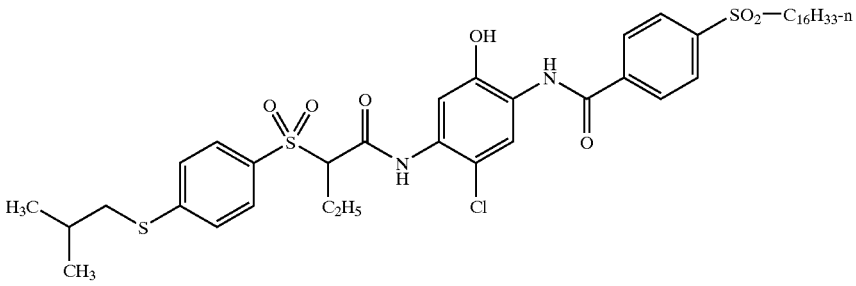 |

-continued
| Suitable cyan couplers are: |
|---|
| I-30 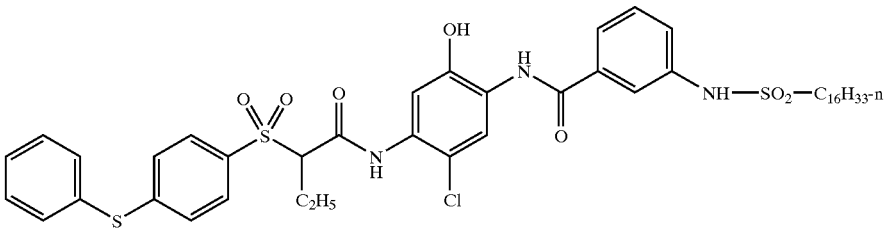 |
| I-31 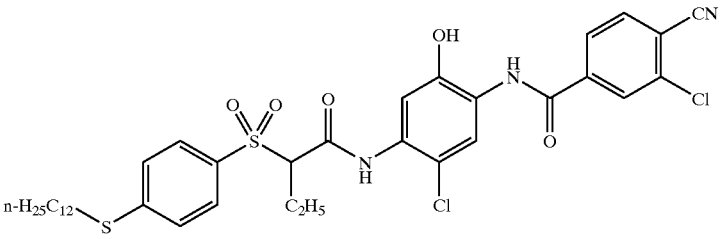 |
| I-32 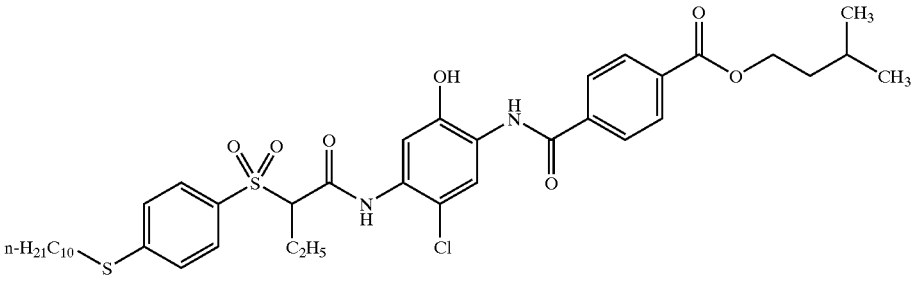 |
| I-33 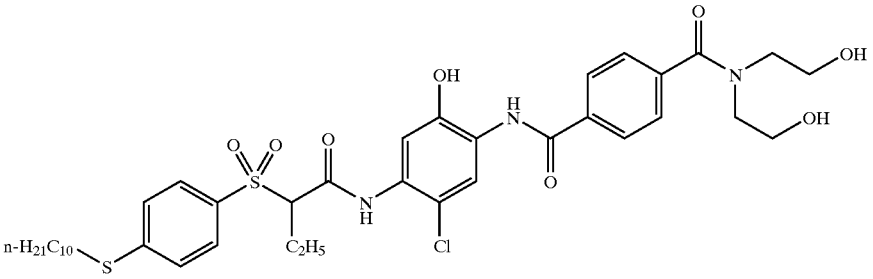 |
| I-34 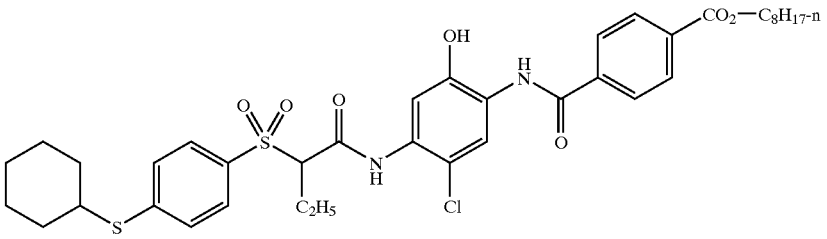 |
| I-35 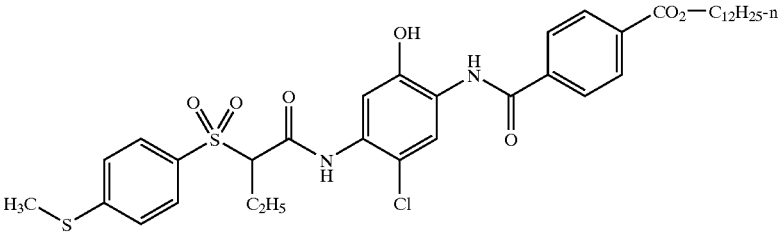 |

-continued
| Suitable cyan couplers are: |
|---|
| I-36 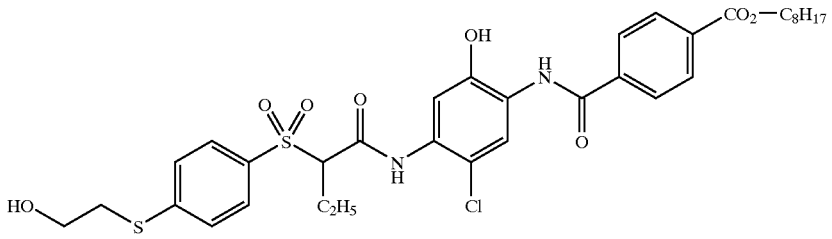 |
| I-37 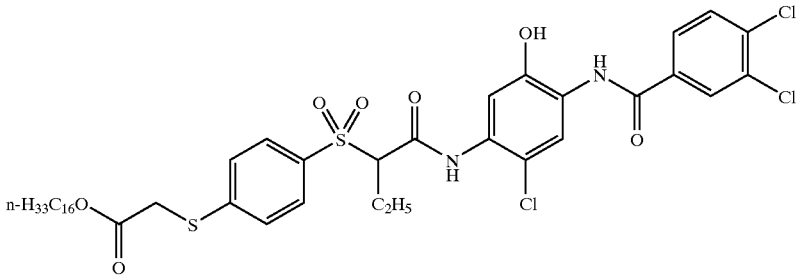 |
| I-38 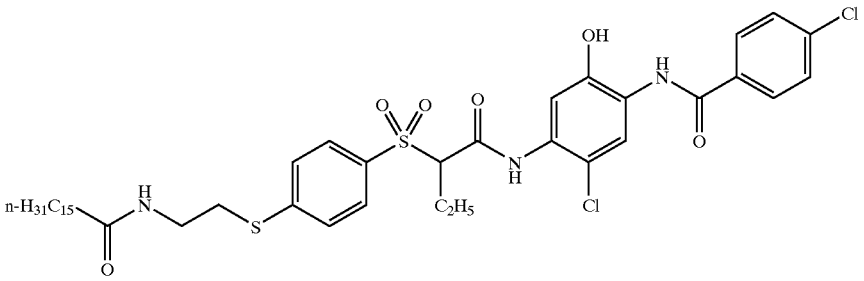 |
| I-39 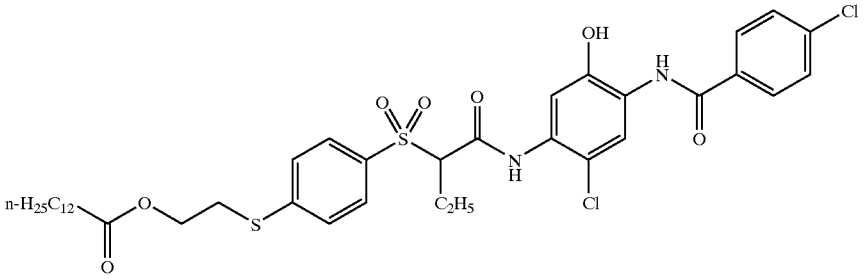 |
| I-40 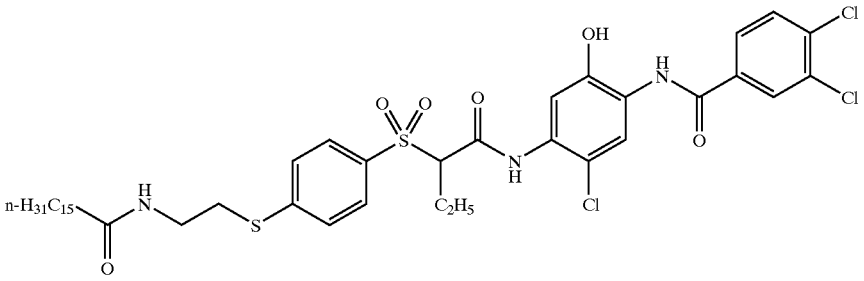 |

Synthesis of Coupler I-10

Synthesis of the Phenolic Coupler Intermediate

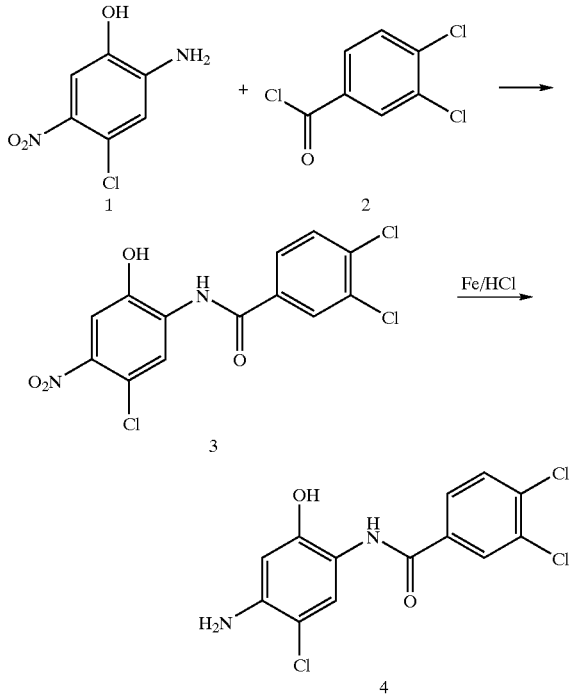

A solution of 185 g (0.87 mol) of 3,4-dichlorobenzoyl chloride 2 in 50 ml of N-methylpyrrolidone is added dropwise with stirring to 165 g (0.87 mol) of 2-amino-4-chloro-5-nitrophenol 1 in 500 ml of N-methylpyrrolidone. Continue stirring for 1 hour at room temperature and then for 2 hours at 60–65° C. After cooling, slowly combine with 500 ml of water and suction filter. Stir twice with water and then twice with methanol and suction filter.

Yield 310 g (98%) of 3

A mixture of 310 g (0.86 mol) of 3, 171 g of iron powder, 2.2 l of ethanol and 700 ml of N-methylpyrrolidone is heated to 65° C. while being stirred. The heating bath is removed and 750 ml of conc. hydrochloric acid are added dropwise within 2 hours. The mixture is then refluxed for 1 hour. After cooling, 1 l of water is added, the mixture suction filtered and washing performed with 2 N hydrochloric acid, then with water until the outflowing water is colourless. The residue is stirred together with 1.5 l of water, the mixture neutralised by addition of sodium acetate and suction filtered. Stir twice more with 1.5 l of methanol and suction filter.

Yield 270 g (95%) of 4

Synthesis of the Ballast Residue

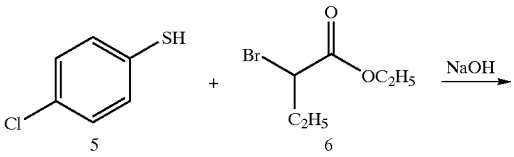

-continued

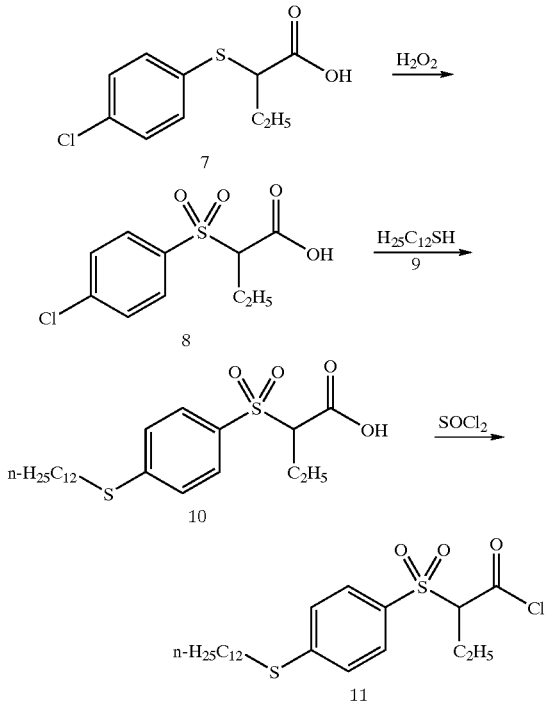

320 g (3.6 mol) of 45% sodium hydroxide solution are added dropwise within 1 hour with stirring to a mixture of 520 g (3.6 mmol) of 4-chlorothiophenol 5 and 652 g (3.6 mol) of 2-bromobutyric acid ethyl ester 6 in 1 l of ethanol. The reaction is strongly exothermic, the temperature being kept at 75–80° C. by cooling, and the mixture is then refluxed for 1 hour. A further 400 g (4.5 mol) of sodium hydroxide solution are slowly added dropwise (weakly exothermic). After refluxing for a farther 2 hours, the mixture is cooled and 1 l of water is added. Extraction is then performed twice with 250 ml of toluene, the combined organic phases are dried and evaporated in the rotary evaporator. The viscous oil 7 (830 g, still contains toluene) is further reacted without purification.

760 ml of hydrogen peroxide (35%) are added dropwise to a solution of 830 g (3.6 mol) of compound 7 and 10 ml of sodium tungstate solution (20%) in glacial acetic acid: the first 300 ml initially with cooling at 35–40° C. and, after removal of the cooling, the remaining 360 ml at 90–95° C. Once addition is complete, stirring is continued for 1 hour at this temperature. Excess peroxide is destroyed by addition of sodium sulfite. The reaction mixture is combined with 2 l of ethyl acetate and 2 l of water, the organic phase is separated and the aqueous phase extracted twice with 700 ml portions of ethyl acetate. The combined organic phases are washed twice with 700 ml portions of water, dried and evaporated under a vacuum. The residue is dissolved in 300 ml of hot ethyl acetate, cooled and, at the onset of crystallisation, combined with 1 l of hexane. The mixture is then suction filtered when cold and rewashing performed with a little hexane. 835 g (88%) of the compound 8 are obtained.

131 g (0.5 mol) of 8 and 111 g (0.55 mol) of dodecyl mercaptan 9 in 300 ml of 2-propanol are combined with stirring with 90 g (1 mol) of sodium hydroxide solution (45%). After the addition of 2.5 g of tetrabutylammonium bromide and 2.5 g of potassium iodide, the mixture is refluxed for 11 hours. After cooling, 350 ml of water are added and the pH is adjusted to 1–2 with approx. 60 ml of conc. hydrochloric acid. Extraction is then performed twice with 100 ml portions of ethyl acetate, the combined organic phases are washed three times with 150 ml portions of water, dried and evaporated. The residue is stirred together with 500 ml of hexane and the mixture suction filtered at 0–5° C. After recrystallisation from 500 ml of hexane/ethyl acetate (10:1), 177 g of 10 are obtained (82%, m.p.: 82° C.).

128 g (0.3 mol) of 10 and 1 ml of dimethylformamide are heated to 65° C. in 300 ml of toluene. 75 ml (1 mol) of thionyl chloride are added dropwise at this temperature within 1 hour. After a further 5 hours, the mixture is evaporated under a vacuum. The highly viscous oil (11, 134 g) is used without further purification.

Synthesis of Coupler I-10

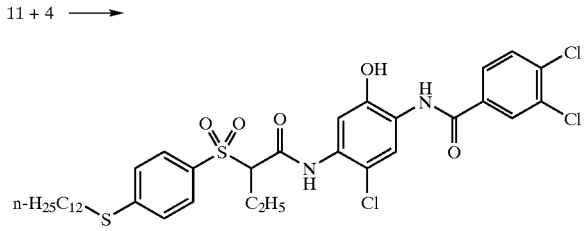

I-10

100 g of the crude product 11 (approx. 0.2 mol) in 100 ml of N-methylpyrrolidone are added dropwise at 5–10° C. to 66 g (0.2 mol) of 4 in 200 ml of N-methylpyrrolidone. The mixture is stirred, initially for 2 hours at room temperature, then for 2 hours at 60° C. The reaction mixture is filtered while hot, the filtrate combined with 500 ml of acetonitrile, cooled to 0° C., suction filtered and rewashed with 50 ml of acetonitrile. The product is combined with 500 ml of methanol and 1 l of water, stirred, suction filtered, then rewashed with 300 ml of water and dried.

Yield: 120 g (81%) of I-10

The red-sensitive layer may contain silver chloride, silver chloride-bromide, silver chloride-iodide or silver chloride-bromide-iodide crystals. The emulsions particularly preferably comprise silver chloride-bromide emulsions with a chloride content of at least 95 mol % and particularly preferably of at least 97 mol %.

The iridium may be incorporated into the crystals in any known manner. It is preferably added as a complex salt in dissolved form at any desired point during emulsion production, in particular before completion of crystal formation.

In a preferred embodiment, iridium(III) and/or iridium (IV) complexes are used, wherein complexes comprising chloro ligands are preferred. Hexachloroiridium(III) and hexachloroiridium(IV) complexes are particularly preferred. The counterions optionally required to offset the charge of the iridium complex ions have no influence on the action according to the invention and may be selected at will.

The present invention also provides a process for the production of a positive reflection print from a colour negative, wherein the image information is exposed onto a print material and the material is subsequently processed in a manner corresponding to its type, which process is characterised in that the above-described print material according to the invention is used.

In a preferred embodiment of the process according to the invention, the colour negative is digitised and exposure is performed with a scanning printer, particular preferably with a laser film recorder.

In a further advantageous embodiment of the process according to the invention, exposure is performed with an analogue printer, particularly preferably with a printer capable of exposing in excess of 1000 prints per hour.

Examples of colour photographic print materials are colour photographic paper, colour reversal photographic paper, semi-transparent display material and colour photographic materials with a deformable substrate, for example made from PVC. A review may be found in Research Disclosure 37038 (1995), Research Disclosure 38957 (1996) and Research Disclosure 40145 (1997).

Photographic print materials consist of a support, onto which at least one photosensitive silver halide emulsion layer is applied. Suitable supports are in particular thin films and sheets. A review of support materials and auxiliary layers applied to the front and reverse sides thereof is given in Research Disclosure 37254, part 1 (1995), page 285 and in Research Disclosure 38957, part XV (1996), page 627. The colour photographic print materials conventionally contain at least one red-sensitive, one green-sensitive and one blue-sensitive silver halide emulsion layer, optionally together with interlayers and protective layers.

Depending upon the type of photographic print material, these layers may be differently arranged. This is demonstrated for the most important products:

Colour photographic paper and colour photographic display material conventionally have on the support, in the stated sequence, one blue-sensitive, yellow-coupling silver halide emulsion layer, one green-sensitive, magenta-coupling silver halide emulsion layer and one red-sensitive, cyan-coupling silver halide emulsion layer; a yellow filter layer is not necessary.

The number and arrangement of the photosensitive layers may be varied in order to achieve specific results. Colour papers, for example, may also contain differently sensitised interlayers, by means of which gradation may be influenced.

The substantial constituents of the photographic emulsion layers are binder, silver halide grains and colour couplers.

Details of suitable binders may be found in Research Disclosure 37254, part 2 (1995), page 286 and in Research Disclosure 38957, part II.A (1996), page 598.

Details of suitable silver halide emulsions, the production, ripening, stabilisation and spectral sensitisation thereof, including suitable spectral sensitisers, may be found in Research Disclosure 37254, part 3 (1995), page 286, in Research Disclosure 37038, part XV (1995), page 89 and in Research Disclosure 38957, part V.A (1996), page 603.

Further red sensitisers which may be considered for the red-sensitive layer are pentamethinecyanines having naphthothiazole, naphthoxazole or benzothiazole as basic end groups, which may be substituted with halogen, methyl or methoxy groups and may be bridged by 9,11-alkylene, in particular 9,11-neopentylene. The N,N' substituents may be $C_4$–$C_8$ alkyl groups. The methine chain may additionally also bear substituents. Pentamethines having only one methyl group on the cyclohexene ring may also be used. The red sensitiser may be supersensitised and stabilised by the addition of heterocyclic mercapto compounds.

The red-sensitive layer may additionally be spectrally sensitised between 390 and 590 nm, preferably at 500 nm, in order to bring about improved differentiation of red tones.

The spectral sensitisers may be added to the photographic emulsion in dissolved form or as a dispersion. Both the solution and dispersion may contain additives such as wetting agents or buffers.

The spectral sensitiser or a combination of spectral sensitisers may be added before, during or after preparation of the emulsion.

Photographic print materials contain either silver chloride-bromide emulsions containing up to 80 mol % of AgBr or silver chloride-bromide emulsions containing above 95 mol % of AgCl.

Details of colour couplers may be found in Research Disclosure 37254, part 4 (1995), page 288, in Research Disclosure 37038, part II (1995), page 80 and in Research Disclosure 38957, part X.B (1996), page 616. In print materials, the maximum absorption of the dyes formed from the couplers and the colour developer oxidation product is preferably within the following ranges: yellow coupler 440 to 450 nm, magenta coupler 540 to 560 nm, cyan coupler 625 to 670 nm.

The yellow couplers associated with a blue-sensitive layer in print materials are almost always two-equivalent couplers of the pivaloylacetanilide and cyclopropylcarbonylacetanilide series.

The magenta couplers conventional in print materials are almost always those from the series of anilinopyrazolones, pyrazolo[5,1-c](1,2,4)triazoles or pyrazolo[1,5-b](1,2,4) triazoles.

The non-photosensitive interlayers generally arranged between layers of different spectral sensitivity may contain agents which prevent an undesirable diffusion of developer oxidation products from one photosensitive layer into another photosensitive layer with a different spectral sensitisation.

Suitable compounds (white couplers, scavengers or DOP scavengers) may be found in Research Disclosure 37254, part 7 (1995), page 292, in Research Disclosure 37038, part III (1995), page 84 and in Research Disclosure 38957, part X.D (1996), pages 621 et seq.

The photographic material may also contain UV light absorbing compounds, optical brighteners, spacers, filter dyes, formalin scavengers, light stabilisers, antioxidants, $D_{min}$ dyes, plasticisers (latices), biocides and additives to improve coupler and dye stability, to reduce colour fogging and to reduce yellowing, and others. Suitable compounds may be found in Research Disclosure 37254, part 8 (1995), page 292, in Research Disclosure 37038, parts IV, V, VI, VII, X, XI and XIII (1995), pages 84 et seq. and in Research Disclosure 38957, parts VI, VIII, IX and X (1996), pages 607 and 610 et seq.

The layers of colour photographic materials are conventionally hardened, i.e. the binder used, preferably gelatine, is crosslinked by appropriate chemical methods.

Suitable hardener substances may be found in Research Disclosure 37254, part 9 (1995), page 294, in Research Disclosure 37038, part XII (1995), page 86 and in Research Disclosure 38957, part II.B (1996), page 599.

Once exposed with an image, colour photographic materials are processed using different processes depending upon their nature. Details relating to processing methods and the necessary chemicals are disclosed in Research Disclosure 37254, part 10 (1995), page 294, in Research Disclosure 37038, parts XVI to XXIII (1995), pages 95 et seq. and in Research Disclosure 38957, parts XVIII, XIX and XX (1996), pages 630 et seq. together with example materials.

Emulsions

Production of the Silver Halide Emulsions

Micrate Emulsion (EmM1) (Undoped Micrate Emulsion)

The following solutions are prepared with demineralised water:

| | | |
|---|---|---|
| Solution 01 | 5500 g | water |
| | 700 g | gelatine |
| | 5 g | n-decanol |
| | 20 g | NaCl |
| Solution 02 | 9300 g | water |
| | 1800 g | NaCl |
| Solution 03 | 9000 g | water |
| | 5000 g | $AgNO_3$ |

Solutions 02 and 03 are simultaneously added with vigorous stirring to solution 01 at 40° C. over the course of 30 minutes with a constant feed rate at pAg 7.7 and pH 5.3. During precipitation, the pAg value is held constant by apportioning an NaCl solution and the pH value by apportioning $H_2SO_4$ to the precipitation tank. An AgCl emulsion having an average particle diameter of 0.09 $\mu$m is obtained. The gelatine/$AgNO_3$ weight ratio is 0.14. The emulsion is ultrafiltered at 50° C., washed and redispersed with such a quantity of gelatine and water that the gelatine/$AgNO_3$ weight ratio is 0.3 and each kg of the emulsion contains 200 g of AgCl. After redispersion, the grain size is 0.13 $\mu$m.

Red-Sensitive Emulsions EmR1–EmR5

EmR1

The following solutions are prepared with demineralised water:

| | | |
|---|---|---|
| Solution 11 | 1100 g | water |
| | 136 g | gelatine |
| | 1 g | n-decanol |
| | 4 g | NaCl |
| | 195 g | EmM1 |
| Solution 12 | 1860 g | water |
| | 360 g | NaCl |
| Solution 13 | 1800 g | water |
| | 1000 g | $AgNO_3$ |

Solutions 12 and 13 are simultaneously added with vigorous stirring to solution 11, which has initially been introduced into the precipitation tank, at 40° C. over the course of 75 minutes at a pAg of 7.7. The pAg and pH values are controlled as during precipitation of emulsion EmM1. Feed is adjusted such that, over the first 50 minutes, the feed rate of solutions 12 and 13 rises in a linear manner from 4 ml/min to 36 ml/min and in the remaining 25 minutes is held at a constant feed rate of 40 ml/min. An AgCl emulsion having an average particle diameter of 0.48 $\mu$m is obtained. The quantity of AgCl in the emulsion is hereinafter converted to $AgNO_3$. The gelatine/$AgNO_3$ weight ratio is 0.14. The emulsion is ultrafiltered, washed and redispersed with such a quantity of gelatine and water that the gelatine/$AgNO_3$ weight ratio is 0.56 and each kg of the emulsion contains 200 g of $AgNO_3$.

The emulsion is chemically ripened at a pH of 5.0 with an optimum quantity of gold(III) chloride and $Na_2S_2O_3$ for 2 hours at a temperature of 75° C. After chemical ripening, the emulsion is spectrally sensitised at 40° C. with 75 $\mu$mol of compound (RS-1) per mol of AgCl and stabilised with 2.5 mmol of (ST-1) per mol of $AgNO_3$. 3 mmol of KBr are then added.

RS-1:

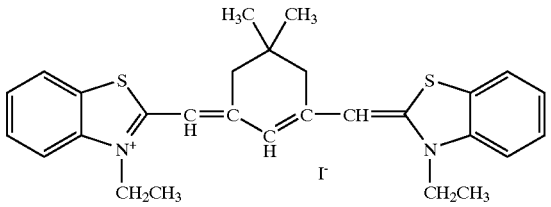

ST-1:

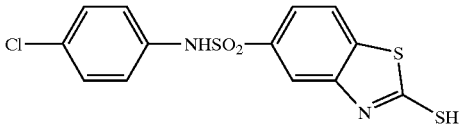

EmR2

As EmR1, except that 56 μg of $K_2IrCl_6$ are added to solution 11. The emulsion contains 20 nmol of $Ir^{4+}$ per mol of AgCl.

EmR3

As EmR1, except that 282 μg of $K_2IrCl_6$ are added to solution 11. The emulsion contains 100 nmol of $Ir^{4+}$ per mol of AgCl.

EmR4

As EmR1, except that 1413 μg of $K_2IrCl_6$ are added to solution 11. The emulsion contains 500 nmol of $k^{4+}$ per mol of AgCl.

EmR5

As EmR1, except that 2826 μg of $K_2IrCl_6$ are added to solution 11. The emulsion contains 1000 nmol of $Ir^{4+}$ per mol of AgCl.

Green-Sensitive Emulsion EmG1

Precipitation, salt removal and redispersion proceed as for the red-sensitive emulsion EmR1. The emulsion is optimally ripened at a pH of 5.0 with gold(III) chloride and $Na_2S_2O_3$ for 2 hours at a temperature of 60° C. After chemical ripening, for each mol of AgCl, the emulsion is spectrally sensitised at 50° C. with 0.6 mmol of compound (GS-1), stabilised with 1.2 mmol of compound (ST-2) and then combined with 1 mmol of KBr.

GS-1

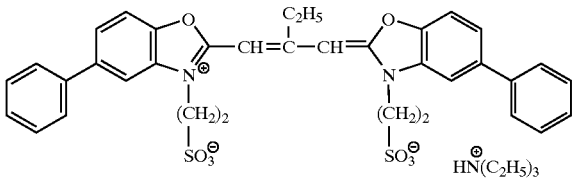

ST-2:

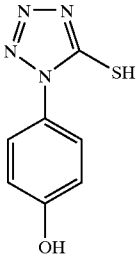

Blue-Sensitive Emulsion EmB1

The following solutions are prepared with demineralised water:

| | | |
|---|---|---|
| Solution 21 | 5500 g | water |
| | 680 g | gelatine |
| | 5 g | n-decanol |
| | 20 g | NaCl |
| | 180 g | EmM1 |
| Solution 22 | 9300 g | water |
| | 1800 g | NaCl |
| Solution 23 | 9000 g | water |
| | 5000 g | $AgNO_3$ |

Solutions 22 and 23 are simultaneously added with vigorous stirring to solution 21, which has initially been introduced into the precipitation tank, at 50° C. over the course of 150 minutes at a pAg of 7.7. The pAg and pH values are controlled as during precipitation of emulsion EmM1. Feed is adjusted such that, over the first 100 minutes, the feed rate of solutions 22 and 23 rises in a linear manner from 10 ml/min to 90 ml/min and in the remaining 50 minutes is held at a constant feed rate of 100 ml/min. An AgCl emulsion having an average particle diameter of 0.85 μm is obtained. The gelatine/$AgNO_3$ weight ratio is 0.14. The emulsion is ultrafiltered, washed and redispersed with such a quantity of gelatine and water that the gelatine/$AgNO_3$ weight ratio is 0.56 and each kg of the emulsion contains 200 g of $AgNO_3$.

The emulsion is ripened at a pH of 5.0 with an optimum quantity of gold(III) chloride and $Na_2S_2O_3$ for 2 hours at a temperature of 50° C. After chemical ripening, for each mol of AgCl, the emulsion is spectrally sensitised at 40° C. with 0.3 mmol of compound BS-1, stabilised with 0.5 mmol of compound (ST-3) and then combined with 0.6 mmol of KBr.

BS-1:

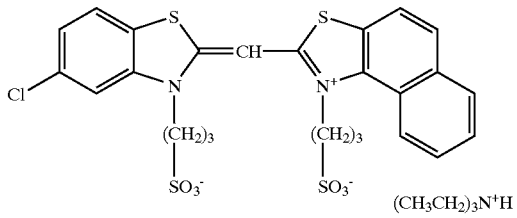

ST-3:

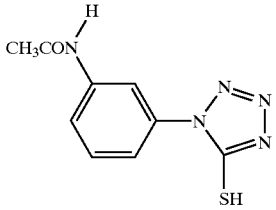

Layer Structure

EXAMPLE 1

A colour photographic recording material suitable for rapid processing was produced by applying the following layers in the stated sequence onto a layer support of paper coated on both sides with polyethylene. Quantities are stated in each case per 1 $m^2$. The silver halide application rate is stated as the corresponding quantities of $AgNO_3$.

Layer Structure 101

Layer 1: (Substrate layer)

0.10 g of gelatine

Layer 2: (Blue-sensitive layer)

Blue-sensitive silver halide emulsion EmB1 (99.94 mol % chloride, 0.06 mol % bromide, average grain diameter 0.85 μm) prepared from 0.4 g of $AgNO_3$.

1.25 g of gelatine 0.30 g of yellow coupler GB-1

0.20 g of yellow coupler GB-2

0.30 g of tricresyl phosphate (TCP)

0.10 g of stabiliser ST-4

Layer 3: (Interlayer)

0.10 g of gelatine 0.06 g of DOP scavenger SC-1

0.06 g of DOP scavenger SC-2

0.12 g of TCP

Layer 4: (Green-sensitive layer)

Green-sensitive silver halide emulsion EmG1 (99.9 mol % chloride, 0.1 mol % bromide, average grain diameter 0.48 μm) prepared from 0.2 g of $AgNO_3$.

1.10 g of gelatine 0.05 g of magenta coupler PP-1

0.10 g of magenta coupler PP-2

0.15 g of stabiliser ST-5

0.20 g of stabiliser ST-6

0.40 g of TCP

Layer 5: (UV protective layer)

1.05 g of gelatine 0.35 g of UV absorber UV-1

0.10 g of UV absorber UV-2

0.05 g of UV absorber UV-3

0.06 g of DOP scavenger SC-1

0.06 g of DOP scavenger SC-2

0.25 g of TCP

Layer 6: (Red-sensitive layer)

Red-sensitive silver halide emulsion EmR1 (99.7 mol % chloride, 0.3 mol % bromide, average grain diameter 0.48 μm) prepared from 0.28 g of $AgNO_3$.

1.00 g of gelatine 0.40 g of cyan coupler according to Table 1

0.20 g of TCP 0.20 g of dibutyl phthalate

Layer 7: (UV protective layer)

1.05 g of gelatine 0.35 g of UV absorber UV-1

0.10 g of UV absorber UV-2

0.05 g of UV absorber UV-3

0.15 g of TCP

Layer 8: (Protective layer)

0.90 g of gelatine 0.05 g of optical brightener W-1

0.07 g of polyvinylpyrrolidone 1.20 ml of silicone oil 2.50 mg of polymethyl methacrylate spacers, average particle size 0.8 μm 0.30 g of instant hardener H-1

The other layer structures differ from 101 with regard to the cyan emulsion EmR1 to EmR5 and with regard to the cyan couplers. Table 1 summarises the results of the tests described below which were carried out on these layer structures.

Analogue Exposure

Photographic properties after analogue exposure were determined by exposing the samples for 40 ms with a constant quantity of light from a halogen lamp under a graduated grey wedge with a density graduation of 0.1/step.

Laser Exposure

Photographic properties after laser exposure were determined by using the following laser film recorder:

| | |
|---|---|
| Red laser: | Laser diode with a wavelength of 638 nm |
| Green laser: | Argon gas laser, 514 nm |
| Blue laser: | Argon gas laser, 458 nm |
| Optical resolution: | 400 dpi |
| Pixel exposure time: | 131 nsec |
| Colour levels produced: | 256 per channel |

First, one field of the samples is exposed at the stated exposure time (131 nsec) with a light intensity I such that the density D after processing (see below) is approx. 0.6 (according to X-Rite status A measurement). Then the light intensity I is reduced or increased such that the logarithm of the light quantity log I.t is 0.1 lower or 0.1 higher than that of the preceding step. The operation is continued until a total of 29 steps have been exposed. The lowest step corresponds to a light intensity of zero.

Selective Exposure

Cyan colour reproduction was determined by exposing samples of the material under a grey wedge for an exposure time of 0.04 msec through a red filter.

Chemical Processing

All samples were processed as follows.

| | | |
|---|---|---|
| a) | Colour developer, 45 s, 35° C. | |
| | Triethanolamine | 9.0 g |
| | N,N-Diethylhydroxylamine | 4.0 g |
| | Diethylene glycol | 0.05 g |
| | 3-Methyl-4-amino-N-ethyl-N-methane-sulfonamidoethylaniline sulfate | 5.0 g |
| | Potassium sulfite | 0.2 g |
| | Triethylene glycol | 0.05 g |
| | Potassium carbonate | 22 g |
| | Potassium hydroxide | 0.4 g |
| | Ethylenediaminetetraacetic acid, disodium salt | 2.2 g |
| | Potassium chloride | 2.5 g |
| | 1,2-Dihydroxybenzene-3,4,6-trisulfonic acid trisodium salt | 0.3 g |
| | make up with water to 1000 ml; pH 10.0 | |
| b) | Bleach/fixing bath, 45 s, 35° C. | |
| | Ammonium thiosulfate | 75 g |
| | Sodium hydrogen sulfite | 13.5 g |
| | Ammonium acetate | 2.0 g |
| | Ethylenediaminetetraacetic acid (iron/ammonium salt) | 57 g |
| | Ammonia, 25% | 9.5 g |
| | make up with acetic acid to 1000 ml; pH 5.5 | |
| c) | Rinsing, 2 min, 33° C. | |
| d) | Drying | |

The results of analogue exposure and of laser exposure are described by the following parameters:

Gamma value G1: Heavy gradation: is the gradient of the secant between the sensitivity point with density D=Dmin+0.10 and the curve point with density D=Dmin+0.85.

Gamma value G2: Medium gradation: is the gradient of the secant between the sensitivity point with density D=Dmin+0.85 and the curve point with density D=Dmin+1.60.

Gamma value G3: Shoulder gradation: is the gradient of the secant between the sensitivity point with density D=Dmin+1.60 and the curve point with density D=Dmin+2.15.

Latent Image Behaviour

The unprocessed samples from the layer structure are exposed in analogue manner in a sensitometer. After 5 seconds and after 5 minutes, the exposed samples are processed in the above-stated process. The cyan colour densities of a grey field with a density of approx. 0.5 are then measured. The change in density as a function of the waiting time between exposure and processing corresponds to the material's latent image behaviour.

The following compounds are used in Example 1:

GB-1

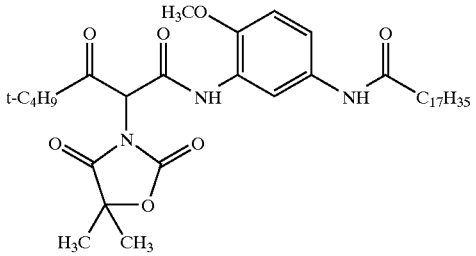

GB-2

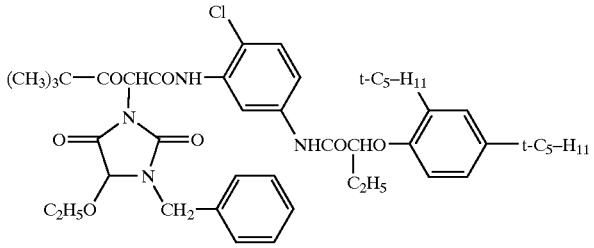

PP-1

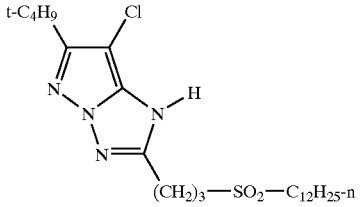

PP-2

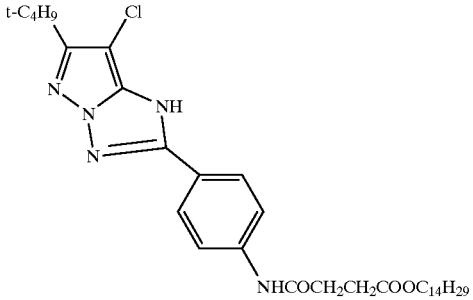

BG-1

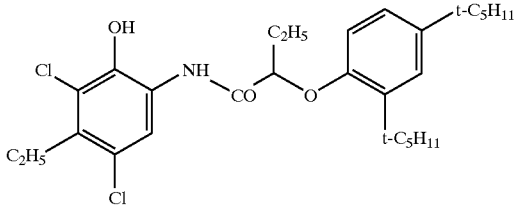

BG-2

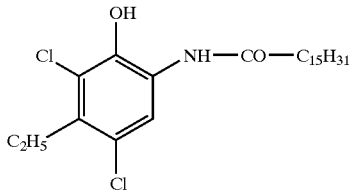

SC-1

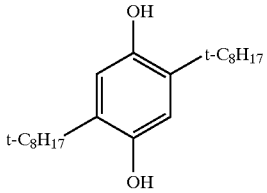

SC-2

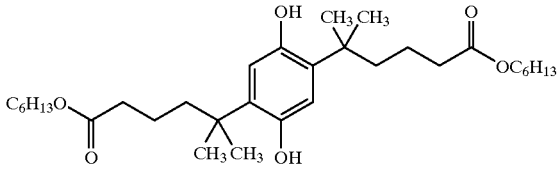

UV-1

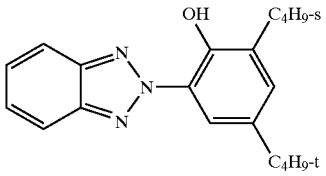

UV-2

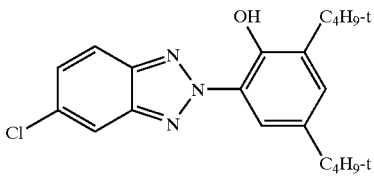

-continued

UV-3

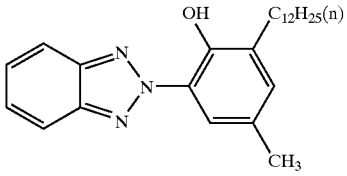

H-1

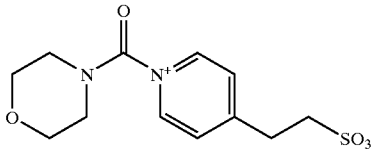

ST-4

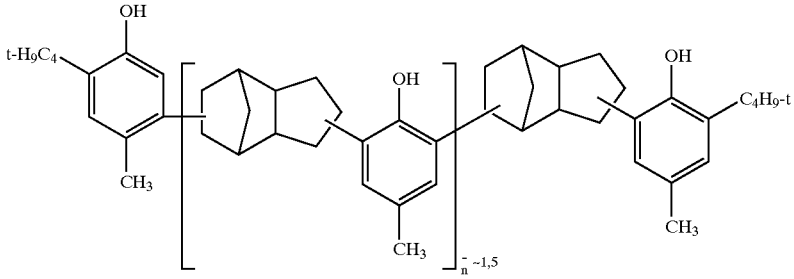

ST-5

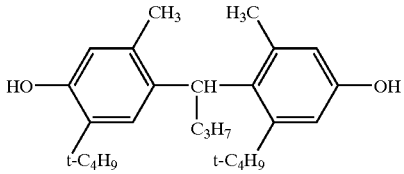

ST-6

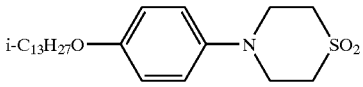

W-1

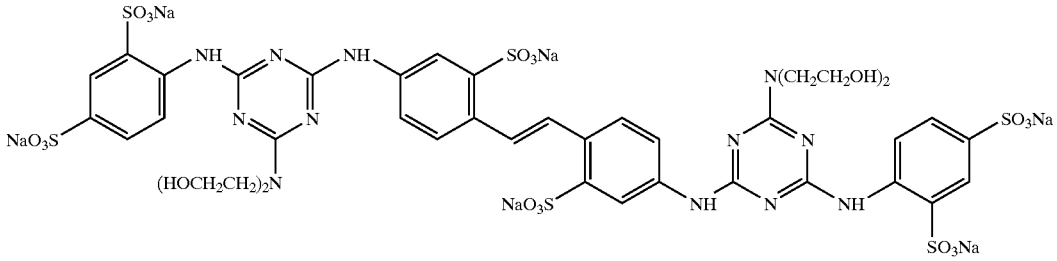

TABLE 1

| Layer structure | Cyan coupler | Quantity of iridium [nmol/mol Ag] | Analogue exposure G1 | Analogue exposure G2 | Analogue exposure G2/G1 ratio | Laser exposure G2 | Laser exposure G3 | Change in density After latent image time | |
|---|---|---|---|---|---|---|---|---|---|
| 101 | BG-1 | 0 | 2.1 | 2.75 | 1.31 | 2.01 | 0.83 | +0.02 | Comparison |
| 102 | BG-1 | 20 | 1.89 | 3.04 | 1.61 | 2.35 | 1.35 | +0.06 | Comparison |
| 103 | BG-1 | 100 | 1.85 | 3.24 | 1.75 | 3.20 | 2.38 | +0.10 | Comparison |
| 104 | BG-1 | 500 | 1.76 | 3.39 | 1.93 | 3.48 | 3.00 | +0.20 | Comparison |
| 105 | BG-1 | 1000 | 1.62 | 3.80 | 2.35 | 3.80 | 3.50 | +0.25 | Comparison |
| 106 | I-1 | 0 | 2.03 | 2.90 | 1.43 | 1.96 | 1.05 | −0.06 | Comparison |
| 107 | I-1 | 20 | 1.86 | 3.18 | 1.71 | 2.54 | 1.94 | −0.02 | Invention |
| 108 | I-1 | 100 | 1.80 | 3.34 | 1.86 | 3.40 | 3.06 | +0.00 | Invention |
| 109 | I-1 | 500 | 1.73 | 3.45 | 2.00 | 3.45 | 3.22 | +0.04 | Invention |
| 110 | I-1 | 1000 | 1.62 | 3.62 | 2.24 | 3.69 | 3.81 | +0.20 | Comparison |
| 111 | BG-2 | 100 | 1.87 | 3.30 | 1.79 | 3.20 | 2.33 | +0.08 | Comparison |
| 112 | BG-2 | 500 | 1.77 | 3.41 | 1.95 | 3.46 | 2.98 | +0.13 | Comparison |

For analogue exposures, the nominal value for G1 is between 1.7 and 1.9. As can be seen from Table 1, this value is only achieved with the quantities of iridium according to the invention.

The G2/G1 ratio shown in Table 1 for the analogue exposure should assume values of between 1.5 and 2.0 if good reproduction of details is to be obtained in the print from colour negative films. According to Table 1, this requirement is also met only with the quantity of iridium according to the invention.

Comparison of the G2 values after laser exposure with a pixel exposure time of 131 ns and after analogue exposure with an area exposure time of 40 ms reveals the gradation reciprocity failure of the comparison structures. The smaller are the differences between these values, the smaller are the differences in gradation between analogue and laser exposure. Only when the differences are small can the same print material be used both for analogue and for scanning exposure. It is clear from Table 1 that the differences decrease as the quantity of iridium increases and the differences are even completely eliminated with the couplers according to the invention.

In the case of laser exposure, the highest possible G3 value is required so that image quality is not impaired by blooming. Surprisingly, the required very high G3 value for laser exposure can only be achieved with the Ir-doped emulsions according to the invention in conjunction with the cyan couplers according to the invention.

The favourable interaction of the couplers according to the invention with the iridium doping according to the invention is particularly clear when latent image stability is taken into consideration; "change in density after latent image time" in Table 1. Only if these values are less than 0.05 density units in absolute terms, is short-term latent image stability satisfactory. At higher values, print behaviour is excessively dependent upon the period of time elapsing between the exposure operation and the processing operation independent therefrom. As the quantity of iridium increases, the change in density after latent image time rises and, with prior art couplers, is excessive even with small quantities of iridium. Excellent latent image stability is only achieved with the couplers according to the invention and the iridium quantity range according to the invention.

In a nutshell, the larger the quantity of iridium in the emulsion, the steeper are G2 and G3 after laser exposure. At the same time, this reduces the difference in G1 and G2 values between laser and analogue exposure. These advantages may, however, only be exploited in the iridium quantity range according to the invention together with the couplers according to the invention, as a result of which a material is obtained which is excellently suited both to analogue exposure and to laser exposure and is distinguished by very good short-term latent image stability.

What is claimed is:

1. A print material having a support, at least one red-sensitive silver halide emulsion layer containing at least one cyan coupler, at least one green-sensitive silver halide emulsion layer containing at least one magenta coupler and at least one blue-sensitive silver halide emulsion layer containing at least one yellow coupler, characterised in that the silver halide crystals of the red-sensitive layer have a chloride content of at least 95 mol %, contain 20 to 500 nmol of iridium per mol of silver halide and the cyan coupler is of the formula (I)

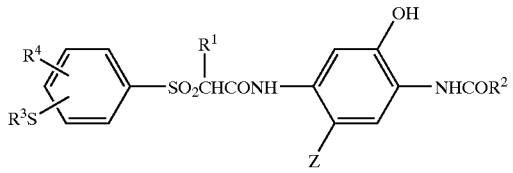

in which $R^1$ means a hydrogen atom or an alkyl group, $R^2$ means an alkyl, aryl or hetaryl group, $R^3$ means an alkyl or aryl group, $R^4$ means an alkyl, alkenyl, alkoxy, aryloxy, acyloxy, acylamino, sulfonyloxy, sulfamoylamino, sulfonamido, ureido, hydroxycarbonyl, hydroxycarbonylamino, carbamoyl, alkylthio, arylthio, alkylamino or arylamino group or a hydrogen atom and Z means a hydrogen atom or a group eliminable under the conditions of chromogenic development.

2. A print material according to claim 1, characterised in that it is a colour negative material.

3. A print material according to one of claim 1, wherein the cyan coupler is of the formula (I-A)

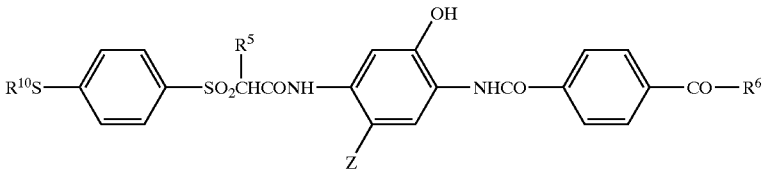

in which $R^5$ means a hydrogen atom or an alkyl group, $R^6$ means $OR^7$ or $NR^8R^9$, $R^7$ means an unsubstituted or substituted alkyl group with 1 to 6 C atoms, $R^8$ means an unsubstituted or substituted alkyl group with 1 to 6 C atoms, $R^9$ means a hydrogen atom or an unsubstituted or substituted alkyl group with 1 to 6 C atoms, $R^{10}$ means an unsubstituted or substituted alkyl group and Z means a hydrogen atom or a group eliminable under the conditions of chromogenic development, wherein the total number of the C atoms of the alkyl groups $R^7$ to $R^{10}$ in a coupler molecule is 8 to 18.

4. A process for the production of a positive reflection print from a color negative, which comprises exposing an image information onto the print material as claimed in claim 1.

5. A process according to claim 4, wherein the color negative is digitised and exposure is performed with a scanning printer.

6. A process according to claim 4, wherein the exposure is performed with an analogue printer.

* * * * *